US006666803B1

(12) United States Patent
Spatafora

(10) Patent No.: US 6,666,803 B1
(45) Date of Patent: Dec. 23, 2003

(54) AUTOMATIC MACHINE

(75) Inventor: Mario Spatafora, Bologna (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 09/469,184

(22) Filed: Dec. 21, 1999

(30) Foreign Application Priority Data

Jan. 11, 1999 (IT) ..... BO99A0007

(51) Int. Cl.[7] ..... B23Q 3/155; B65G 37/00
(52) U.S. Cl. ..... 483/16; 483/1; 198/346.1
(58) Field of Search ..... 483/16, 1; 131/58; 414/752.1, 744.3; 198/346.1, 473.1

(56) References Cited

U.S. PATENT DOCUMENTS 4,587,716 A * 5/1986 Bytow ..... 483/14
4,750,531 A * 6/1988 Juenkersfeld et al. ..... 141/1
4,915,208 A * 4/1990 Juenkersfeld et al. .... 198/346.1
4,930,619 A * 6/1990 Fischer et al. ..... 198/346.1
4,991,281 A * 2/1991 Ikeda et al. ..... 29/401.1
5,087,169 A * 2/1992 Tubke ..... 414/744.3
5,209,247 A * 5/1993 Rittershaus et al. ..... 131/58
5,353,490 A * 10/1994 Kukuljan ..... 29/564
5,394,975 A * 3/1995 Bernhard ..... 198/473.1
5,474,251 A * 12/1995 Neri ..... 242/554.2
5,486,151 A * 1/1996 Bergmann et al. ..... 483/1
5,544,677 A * 8/1996 Okubo ..... 139/245
5,586,387 A * 12/1996 Nakatani et al. ..... 29/703
5,605,432 A * 2/1997 Fink et al. ..... 414/752.1
5,833,902 A * 11/1998 Coxhead et al. ..... 264/106

FOREIGN PATENT DOCUMENTS

DE 3538993 4/1987
EP 0618161 A2 * 10/1994 ..... 29/33 R
JP 410132805 A * 5/1998 ..... 29/33 R
WO WO 97/46450 12/1997

* cited by examiner

*Primary Examiner*—A. L. Wellington
*Assistant Examiner*—Dana D Ross
(74) *Attorney, Agent, or Firm*—Davidson Berquist Klima & Jackson, LLP

(57) ABSTRACT

In an automatic machine for wrapping items for the tobacco industry, a manipulator is designed to transfer at least one interchangeable processing tool toward and away from an operating position, the processing tool being mounted on a frame of the automatic machine.

16 Claims, 3 Drawing Sheets

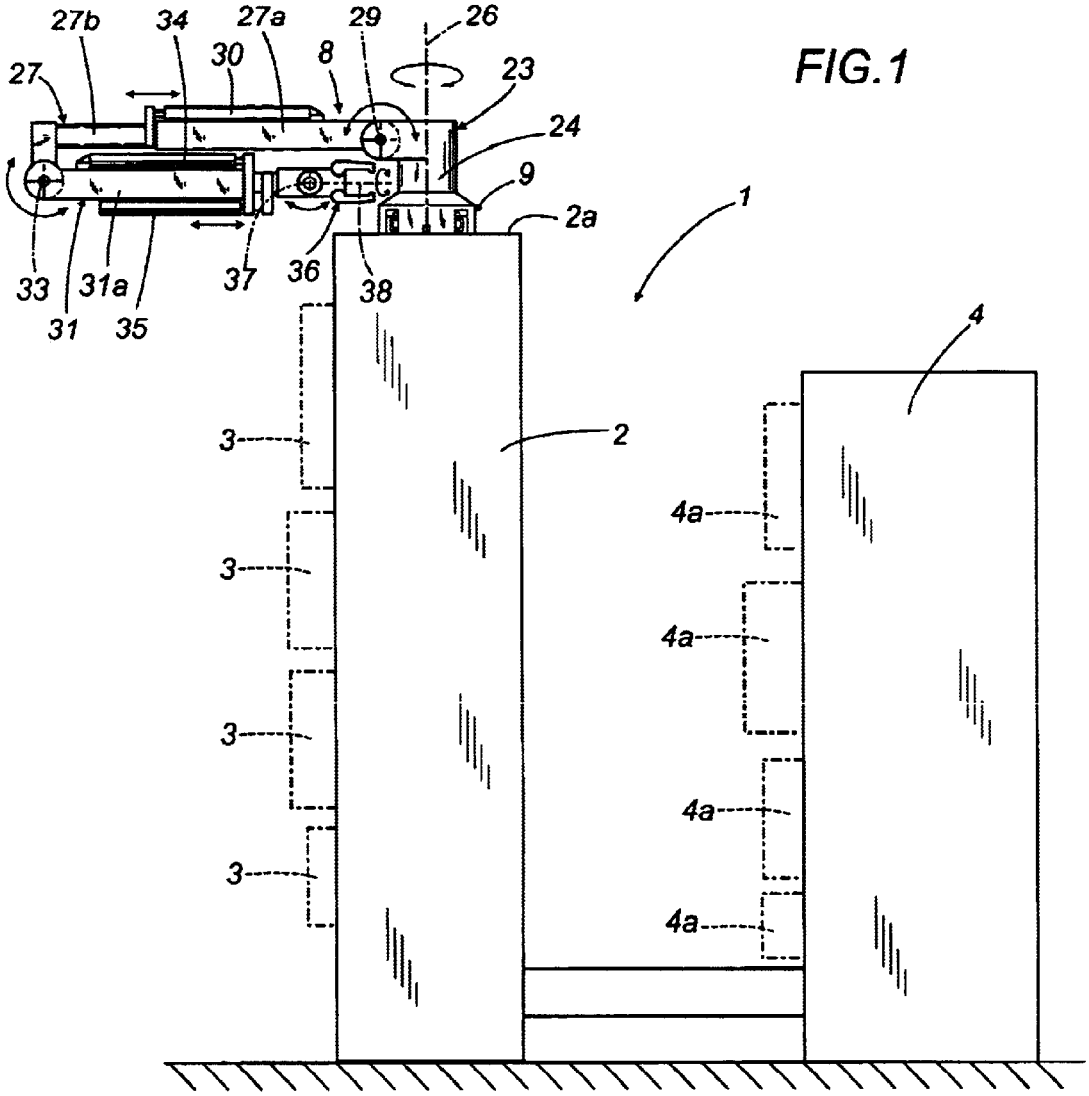
FIG.1
FIG.3
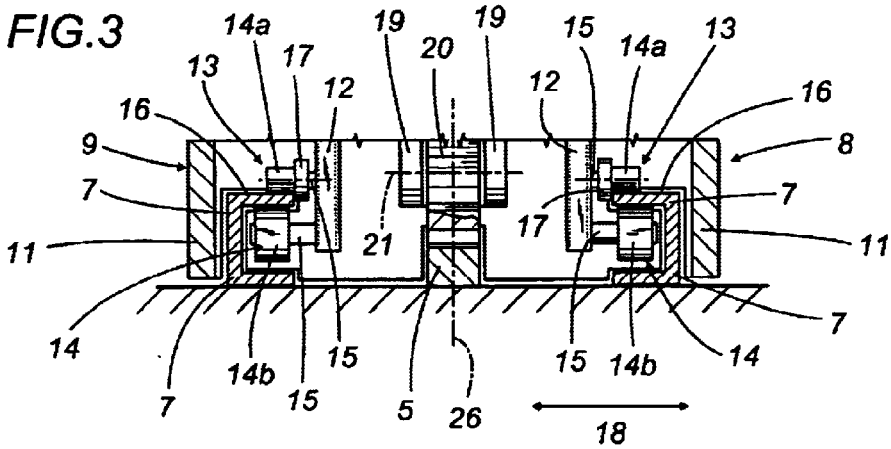

AUTOMATIC MACHINE

BACKGROUND OF THE INVENTION

The present invention relates to an automatic machine.

In particular, the present invention relates to an automatic machine for processing items for the tobacco industry, which the present description will reference without thereby losing in generality.

In the processing of items for the tobacco industry it is known to use automatic packaging machines for packaging sets of cigarettes in corresponding soft or rigid packs.

Known packaging machines generally comprise: a feeder, designed to feed cigarettes to a device for forming sets of cigarettes; a conveyor with pockets, designed to receive in succession the sets of cigarettes just formed; and a wrapping line, designed to receive the sets of cigarettes carried by the pocket conveyor and in turn comprising a plurality of wrapping wheels which are arranged in succession along a set wrapping path.

In packaging machines for producing cigarette packs of the rigid type, the wrapping line generally comprises a first wrapping wheel along which each set of cigarettes is wrapped in a respective protective enclosure, preferably made of metallized paper, in order to constitute a wrapped cigarette set; a transfer wheel, along which each wrapped cigarette: set is associated with a respective inner frame and a second wrapping wheel, along which a cardboard blank is wrapped around each wrapped set of cigarettes and around the corresponding inner frame.

In packaging machines used to produce cigarette packs of the soft type, the wrapping line generally comprises a first wrapping wheel, along which each set of cigarettes is wrapped in a respective protective enclosure, preferably made of metallized paper, in order to constitute a wrapped set of cigarettes; and a second wrapping wheel, along which an external wrapping sheet is wrapped around each wrapped set of cigarettes.

Packaging machines of the kind described above are further provided with respective devices for feeding all the different wrapping materials used in the various steps of packaging the corresponding sets of cigarettes.

Market requirements suggest that cigarette manufacturers should diversify their products and therefore provide several types of rigid packs and soft packs, which differ in terms of cigarette size, number and arrangement of the cigarettes inside the pack, and/or in the shape and appearance of the pack.

In view of the above, it logically follows that each packaging machine has a fixed main structure and a series of interchangeable wrapping tools and attachments which allow the same automatic machine to be used to produce different types rigid packs and soft packs. These wrapping tools are generally quite heavy and bulky and, further, are fitted at points of the packaging machine which are difficult to access.

A major drawback of the packaging machines described above is that the replacement of the wrapping tools in order to equip the machine according to the format of the packs being produced, is performed manually. The changeover procedures create serious operating difficulties for the personnel concerned and, even at the best of times, are lengthy and time-consuming.

The aim of the present invention is to provide an automatic machine which is free from the above drawbacks.

SUMMARY OF THE INVENTION

Accordingly, the present invention provides an automatic machine for processing items for the tobacco industry, said automatic machine comprising a frame, a processing tool, which is detachably mounted on said frame in a preset operating position, and at least one manipulator for moving said processing tool with respect to the frame toward and away from said operating position.

BRIEF DESCRIPTION OF THE DRAWINGS

The invention will now be described with reference to the accompanying drawings, which illustrate an embodiment of the invention without restricting the scope of the inventive concept and in which:

FIG. 1 is a schematic side view of a preferred embodiment of the automatic machine according to the present invention, which is provided with an auxiliary manipulator shown in the inactive position;

FIG. 3 is a sectional view through the plane III—III of FIG. 2, with parts cut away to better illustrate others.

DESCRIPTION OF THE PREFERRED EMBODIMENTS

Figure 2:
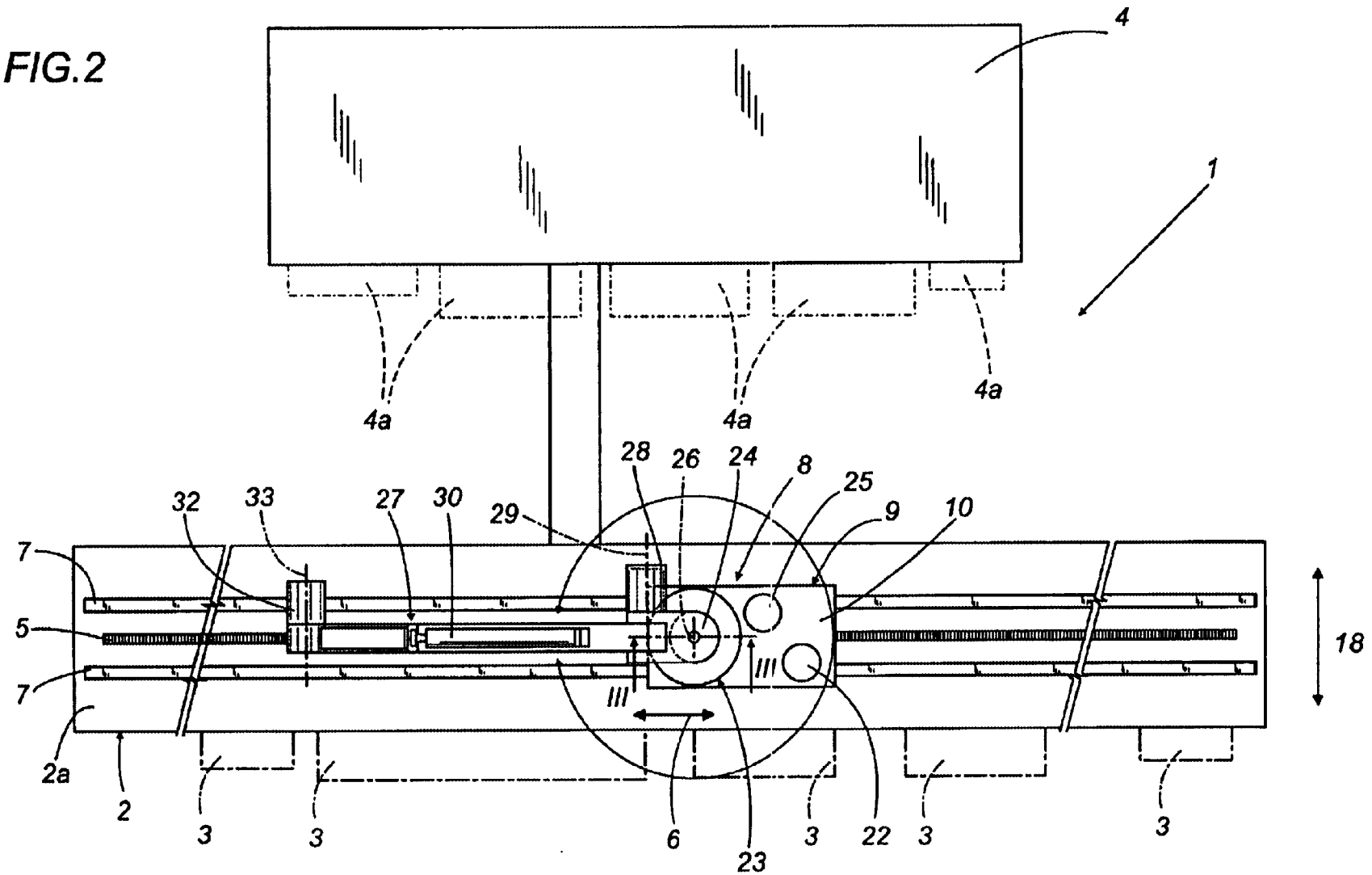
FIG. 2 is a plan view of the automatic machine illustrated in FIG. 1.

With reference to FIG. 1, the numeral 1 indicates as a whole an automatic machine for wrapping items for the tobacco industry.

The machine 1 comprises a frame 2 which is substantially shaped like a prism with a rectangular base and supports a plurality of wrapping tools 3 which are detachably mounted on said frame 2. The machine 1 further comprises a control unit 4, which is provided with a plurality of electric controllers 4*a*, each of which is designed to control the operation of a corresponding tool 3. The tools 3 include pocket conveyors, transfer wheels, wrapping wheels, devices for feeding wrapping material or other items, and can be replaced with similar tools (not illustrated) according to the characteristics of the items to be wrapped and of the end product required.

With reference to FIGS. 1 to 3, the frame 2 is limited, at the top, by a flat surface 2*a* whereon there is a rack 5, which runs in a substantially horizontal direction 6, and two straight guides 7, which run parallel to the direction 6 and are arranged on opposite sides of said rack 5; each guide consists of a C-section which is mounted in such a way that its concave region faces the rack 5.

The two guides 7 slidingly support a robotized manipulator 8 which comprises a slider 9 consisting of a flat plate 10, fitted parallel to the surface 2*a* and having two lateral ribs 11 which are parallel to the direction 6 and protrude from the plate 10 toward said surface 2*a*, and two intermediate ribs 12, which are parallel to the ribs 11, lie between said ribs 11 sad protrude from the plate 10 toward the surface 2*a*.

The two intermediate ribs 12 enter the space between the guides 7 and support respective sets 13 of wheels 14, each wheel being rotatably mounted on its shaft 15 and extending from the corresponding rib 12 toward the adjacent guide 7 transversely to the direction 6. The wheels 14 of each set 13 comprise wheels 14*a*, only one of which is shown, which cooperate with an upper surface of a wing 16 of the corresponding guide 7, and wheels 14*b*, only one of which is shown, which cooperate with a lower surface of said wing 16 of the corresponding guide 7 in order to control the position of the slider 9 at right angles to the surface 2*a*.

Each wheel 14*a* has, at the end of it that is directed toward the corresponding rib 12, a respective protruding cylindrical collar 17 which is coaxial to said wheel 14*a* in order to allow the slider 9 to cooperate with the two guides 7 substantially without play horizontally and transversely to the direction 6.

A fork 19 protrudes from the surface of the plate 10 that faces the surface 2*a* and rotatably supports a sprocket 20 which is mounted on said fork 19 and is driven by a motor 22 so as to rotate about its axis 21 which is parallel to the direction 18. The sprocket 20 meshes with the rack 5 in order to move the slider 9 along the guide 7 in the direction 6.

The manipulator 8 further comprises a substantially cylindrical turret 23 which comprises a dome 24 which is rotatably mounted an the slider 9 in order to rotate about a vertical axis 26 with respect to said slider 9 and under the action of an actuation device 25 which meshes, in a known manner, with said dome 24. A telescopic arm 27 is hinged to the upper end of the dome 24 and is designed to rotate with respect to said dome 24 and under the action of a known type of actuation device 28, about a horizontal axis 29 whose orientation about the vertical axis 26 depends on the orientation of the dome 24 about said axis 26.

The arm 27 comprises two elements 27*a* and 27*b*, the second of which is mounted so that it can slide axially inside the element 27*a* in order to slide axially, with respect to said element 27*a*, under the thrust action of a corresponding actuation cylinder 30.

A telescopic arm 31 is rotatably mounted at the free end of the arm 27 and can rotate, with respect to the arm 27 and under the action of a known type of actuation device 32, about an axis 33 which is parallel to the axis 29. The arm 31 comprises three elements 31*a*, 31*b* and 31*c* the element 31*b* is mounted so that it can slide axially inside the element 31*a* in order to slide axially, with respect to said element 31*a*, under the thrust action of a corresponding actuation cylinder 34; and the element 31*c* is mounted so that it can slide axially in the element 31*b* in order to slide axially, with respect to said element 31*b*, under the thrust action of a corresponding actuation cylinder 35.

A grip element 36, substantially shaped like a clamp, is connected to the free end of the arm 31 and is rotatably coupled to the arm 31 in such a way as to rotate, with respect to said arm 31 and under the action of conventional actuation devices (not illustrated), about an axis 37 which is parallel to the axes 29 and 33 and respectively about an axis 38 which is perpendicular to the axis 37.

Figure 4:
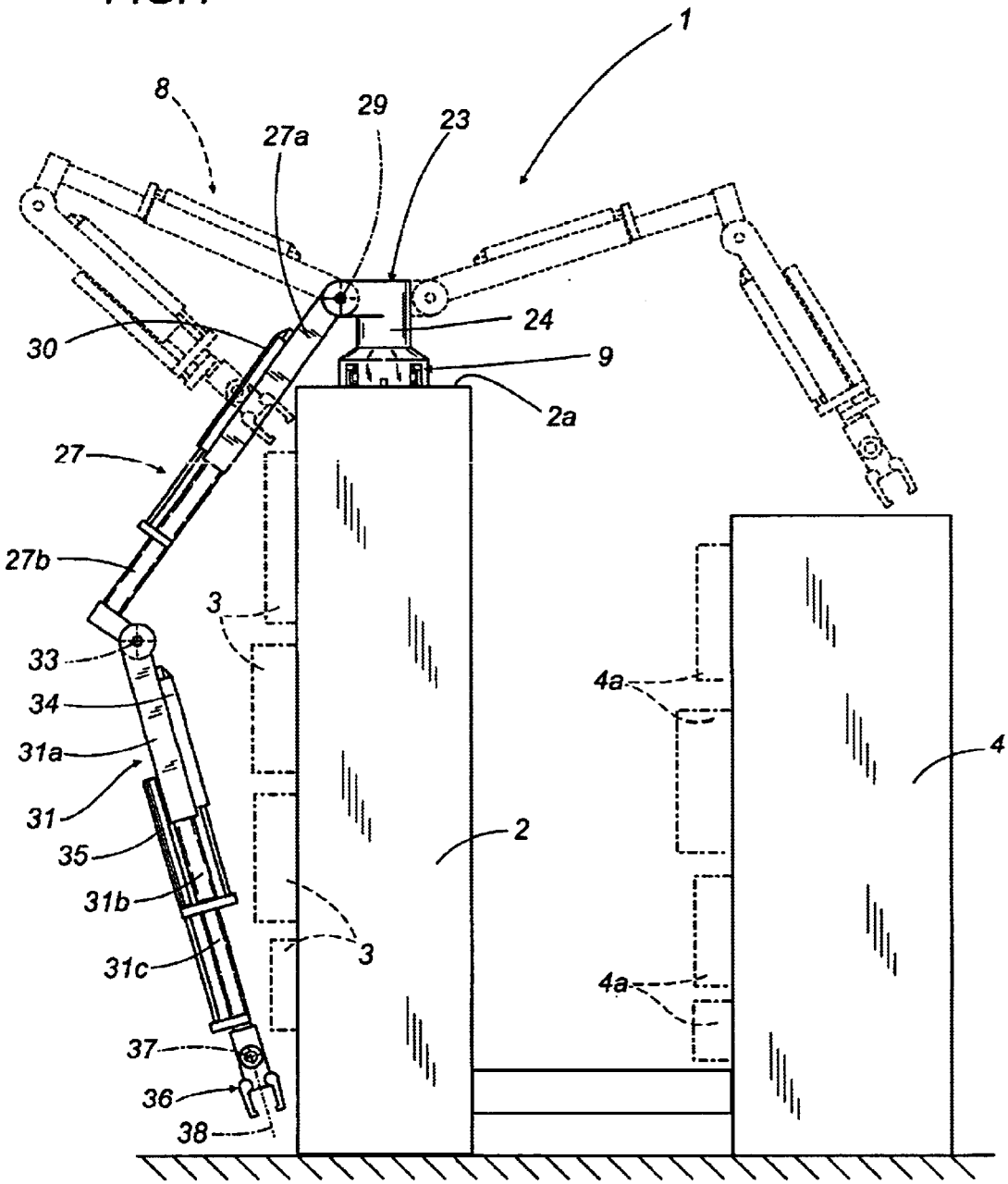
FIG. 4 is a schematic side view of the automatic machine shown in FIG. 1, with the auxiliary manipulator in different operating positions.

According to alternative embodiments (not illustrated), the grip element 36 shown in FIGS. 1 and 4 can be replaced with different grip elements 36, chosen according to the dimensions and shape of the tools 3 and of the electric controllers 4*a* to be moved.

As shown in FIG. 4, the manipulator 8 is made in such a way that it can access all the regions of the automatic machine 1, so as to act both on the wrapping tools 3 supported by the frame 2 and on the electric controllers 4*a* of the control unit 4. The presence of the manipulator 8 therefore makes it possible to quickly and easily remove and replace the wrapping tools 3 and the electric controllers 4*a* in order to appropriately equip the automatic machine 1 according to the dimensions and shape of the items being processed in the automatic machine 1.

The operation of the manipulator 8 can be easily inferred from the above description and therefore requires no further explanation.

What is claimed is:

1. An automatic machine for processing items for the tobacco industry, said automatic machine comprising:

a frame, a processing tool, which is detachably mounted on said frame in a preset operating position, at least one manipulator for moving said processing tool with respect to said frame toward and away from said operating position, guiding means which are axially connected to said frame, and actuation means designed to move the manipulator along said guiding means, wherein the manipulator comprises at least two sets of wheels, each set comprising a plurality of wheels which are vertically offset in such a way that the manipulator is coupled to the guiding means substantially without vertical play.

2. The automatic machine according to claim 1, further comprising a control unit provided with at least one electric controller; said manipulator being also designed to move said electric controller during the replacement of the electric controller.

3. The automatic machine according to claim 1, wherein the manipulator comprises at least one telescopic arm which in turn comprises at least one first portion and at least one second portion; said second portion being mounted so that it can slide inside said first portion.

4. The automatic machine according to clam 3, wherein the manipulator comprises a grip element which is rotatably mounted at a free end of the telescopic arm in such a way as to rotate, with respect to said telescopic arm, about a first axis and, respectively, about a second axis; said first and second axes being perpendicular to one another.

5. The automatic machine according to claim 3, further comprising a control unit provided with at least one electric controller; said manipulator being also designed to move said electric controller during the replacement of the electric controller.

6. The automatic machine according to claim 4, wherein the manipulator is designed to rotate about a third axis which is perpendicular to the first axis.

7. The automatic machine according to claim 4, further comprising a control unit provided with at least one electric controller; said manipulator being also designed to move said electric controller during the replacement of the electric controller.

8. The automatic machine according to claim 6, further comprising a control unit provided with at least one electric controller; said manipulator being also designed to move said electric controller during the replacement of the electric controller.

9. An automatic machine for processing items for the tobacco industry, said automatic machine comprising:

a frame, a processing tool, which is detachably mounted on said frame in a preset operating position, at least one manipulator for moving said processing tool with respect to said frame toward and away from said operating position, at least one guide which is axially connected to said frame, and an actuator for moving the manipulator along the at least one guide, wherein the manipulator comprises at least two sets of wheels, each set comprising a plurality of wheels which are vertically offset in such a way that the manipulator is coupled to the at least one guide substantially without vertical play.

10. The automatic machine according to claim 9, further comprising a control unit provided with at least one electric controller; said manipulator being also designed to move said electric controller during the replacement of the electric controller.

11. The automatic machine according to claim 9, wherein the manipulator comprises at least one telescopic arm which in turn comprises at least one first portion and at least one second portion; said second portion being mounted so that it can slide inside said first portion.

12. The automatic machine according to claim 11, wherein the manipulator comprises a grip element which is rotatably mounted at a free end of the telescopic arm in such a way as to rotate, with respect to said telescopic arm, about a first axis and, respectively, about a second axis; said first and second axes being perpendicular to one another.

13. The automatic machine according to claim 11, further comprising a control unit provided with at least one electric controller; said manipulator being also designed to move said electric controller during the replacement of the electric controller.

14. The automatic machine according to claim 12, wherein the manipulator is designed to rotate about a third axis which is perpendicular to the first axis.

15. The automatic machine according to claim 12, further comprising a control unit provided with at least one electric controller; said manipulator being also designed to move said electric controller during the replacement of the electric controller.

16. The automatic machine according to claim 14, further comprising a control unit provided with at least one electric controller; said manipulator being also designed to move said electric controller during the replacement of the electric controller.

* * * * *